US010821589B2

(12) United States Patent
Schmid et al.

(10) Patent No.: US 10,821,589 B2
(45) Date of Patent: Nov. 3, 2020

(54) PERCUSSIVE POWER TOOL

(71) Applicant: Hilti Aktiengesellschaft, Schaan (LI)

(72) Inventors: Stefan Schmid, Untermühlhausen (DE); Markus Holubarsch, Landsberg am Lech (DE); Markus Hartmann, Mauerstetten (DE); Eduard Pfeiffer, Halblech (DE)

(73) Assignee: HILTI AKTIENGESELLSCHAFT, Schaan (LI)

( * ) Notice: Subject to any disclaimer, the term of this patent is extended or adjusted under 35 U.S.C. 154(b) by 207 days.

(21) Appl. No.: 16/061,377

(22) PCT Filed: Dec. 6, 2016

(86) PCT No.: PCT/EP2016/079833
§ 371 (c)(1),
(2) Date: Jun. 12, 2018

(87) PCT Pub. No.: WO2017/102418
PCT Pub. Date: Jun. 22, 2017

(65) Prior Publication Data

US 2018/0370007 A1 Dec. 27, 2018

(30) Foreign Application Priority Data

Dec. 15, 2015 (EP) ..... 15200145

(51) Int. Cl.
*B25D 11/00* (2006.01)
*B25D 11/12* (2006.01)
*B25D 17/06* (2006.01)

(52) U.S. Cl.
CPC ..... *B25D 11/005* (2013.01); *B25D 11/125* (2013.01); *B25D 17/06* (2013.01);
(Continued)

(58) Field of Classification Search
CPC .... B25D 11/005; B25D 11/125; B25D 17/06; B25D 17/0019; B25D 2250/035;
(Continued)

(56) References Cited

U.S. PATENT DOCUMENTS 1,093,302 A * 4/1914 Wagner ..... F01B 17/02 60/370
2,823,646 A * 2/1958 Brown ..... B25D 9/08 173/169

(Continued)

FOREIGN PATENT DOCUMENTS

DE 33 28 886 A1 2/1984
EP 1 607 187 A1 12/2005

(Continued)

OTHER PUBLICATIONS

International Bureau, International Search Report in International Application No. PCT/EP2016/079833, dated Feb. 23, 2017.

*Primary Examiner* — Nathaniel C Chukwurah
*Assistant Examiner* — Lucas E. A. Palmer
(74) *Attorney, Agent, or Firm* — Leydig Voit & Mayer, Ltd.

(57) ABSTRACT

A percussion mechanism contains a guide tube, an exciter piston, a hammer, a pneumatic chamber for coupling the hammer to the motion of the exciter piston, a striker, and a seat for the striker. The hammer has a striking point, defined by a striking surface of the striker when the striker lies against the seat. A check valve has an outlet opening and a closing mechanism for closing the check valve against an air flow from the interior of the guide tube. The outlet opening is arranged in such a way that the outlet opening is closed by the hammer during striking operation and otherwise is open.

9 Claims, 3 Drawing Sheets

(52) U.S. Cl.
CPC ..... *B25D 2217/0019* (2013.01); *B25D 2250/035* (2013.01); *B25D 2250/131* (2013.01); *B25D 2250/185* (2013.01); *B25D 2250/231* (2013.01); *B25D 2250/365* (2013.01)

(58) Field of Classification Search
CPC ..... B25D 2250/131; B25D 2250/185; B25D 2250/231; B25D 2250/365
See application file for complete search history.

(56) References Cited

U.S. PATENT DOCUMENTS 2,899,934 A * 8/1959 Salengro ..... B25D 17/245 173/18
3,086,501 A * 4/1963 Nielsen ..... B25D 9/08 173/137
3,114,421 A * 12/1963 McCloud ..... B25D 16/00 173/14
3,245,483 A * 4/1966 Etzkorn ..... B25D 17/08 173/137
4,114,699 A * 9/1978 Wolf ..... B25D 16/00 173/109
4,349,074 A * 9/1982 Ince ..... B25D 9/08 173/48
4,932,479 A * 6/1990 Pyatov ..... B23Q 5/027 173/14
5,111,890 A * 5/1992 Ranger ..... B25D 11/005 173/104
5,161,623 A * 11/1992 Erlach ..... B25D 11/125 173/14
5,775,440 A * 7/1998 Shinma ..... B25D 11/005 173/109
5,873,418 A * 2/1999 Arakawa ..... B25D 11/005 173/109
6,116,352 A 9/2000 Frauhammer et al.
6,467,555 B2 * 10/2002 Plank ..... B25D 11/005 173/109
6,913,088 B2 * 7/2005 Berger ..... B25D 11/005 173/201
10,058,987 B2 * 8/2018 Wiedner ..... B25D 11/06
2002/0108766 A1 8/2002 Plank et al.
2008/0296034 A1 * 12/2008 Braun ..... B25D 11/005 173/4
2010/0224383 A1 * 9/2010 John ..... B25D 11/125 173/201
2010/0300718 A1 * 12/2010 Hartmann ..... B25D 11/005 173/201
2011/0303429 A1 * 12/2011 Kohlschmied ..... B25D 17/06 173/112
2012/0024555 A1 * 2/2012 Sugiyama ..... B25D 17/06 173/211
2013/0277077 A1 * 10/2013 Hartmann ..... B25D 9/06 173/1
2013/0277080 A1 * 10/2013 Hartmann ..... B25D 17/245 173/212
2013/0284473 A1 * 10/2013 Hartmann ..... B25D 11/125 173/1
2014/0083727 A1 * 3/2014 Gensmann ..... B25D 11/125 173/1
2016/0271779 A1 9/2016 Hartmann et al.
2016/0311103 A1 * 10/2016 Wiedner ..... B25D 16/00

FOREIGN PATENT DOCUMENTS

EP 2 653 270 A2 10/2013
NL 7709910 A 3/1978
WO WO 2015/067590 A1 5/2015
WO WO 2017/102429 A1 6/2017
WO WO 2017/102431 A1 6/2017
WO WO 2017/102437 A1 6/2017

* cited by examiner

PERCUSSIVE POWER TOOL

CROSS-REFERENCE TO RELATED APPLICATIONS

This patent application is the U.S. National Stage of International Patent Application No. PCT/EP2016/079833, filed Dec. 6, 2016, which claims the benefit of European Patent Application No. 15200145.9, filed Dec. 15, 2015, which are each incorporated by reference.

FIELD OF THE INVENTION

The present invention relates to a percussion machine tool, in particular a hand-held pneumatic hammer drill and a hand-held pneumatic electric chisel.

BACKGROUND OF THE INVENTION

A hand-held pneumatic hammer drill comprises a pneumatic percussion mechanism, which is driven by a motor. A pneumatic chamber forms an air spring, which couples a percussion means to an exciter that is moved by the motor. The percussion mechanism is deactivated when the user does not apply any contact pressure to the tool in order to protect the percussion mechanism against excessive loading. As soon as the user presses the hammer drill against the tool, the percussion mechanism starts to work again. In high-powered machines, it has proven difficult to control the process of guiding the hammer drill when pressing it against the tool once again.

BRIEF SUMMARY OF THE INVENTION

The machine tool according to the invention comprises a tool holder for holding a percussion tool on a working axis, a motor and a percussion mechanism. The percussion mechanism contains a guide tube, an exciter that is forced to move periodically along the working axis inside the guide tube by means of the motor, a percussion means that slides along the working axis inside the guide tube, a pneumatic chamber, which is enclosed by the exciter and the percussion means inside the guide tube, for coupling the percussion means to the movement of the exciter, a rivet header and a seat for the rivet header. The percussion mechanism comprises a point of percussion for the percussion means, which point is defined by a percussion surface of the rivet header that faces the percussion means when the rivet header rests against the seat counter to the percussion direction. A check valve comprises an outlet opening that is arranged in the guide tube and a closure mechanism for closing the check valve with respect to a flow of air passing out of the interior of the guide tube. The outlet opening is arranged along the working axis such that the percussion means seals the outlet opening with respect to the pneumatic chamber when the percussion means is in front of the point of percussion in the percussion direction, and such that the pneumatic chamber overlaps the outlet opening when the percussion means moves beyond the point of percussion in the percussion direction.

The outlet opening of the check valve is sealed by the percussion means when the percussion mechanism is carrying out a percussive operation, and is opened when the percussion means is not striking at anything. The check valve allows air to flow into the pneumatic chamber and deactivates the air spring of the pneumatic chamber. However, the check valve does not allow any air to leave the pneumatic chamber. This has proven advantageous when pressing the hammer drill against the tool once again. The user has to move the tool, the rivet header and the percussion means against the pressure in the pneumatic chamber. The counterpressure allows for more effective guidance of the drill.

One embodiment provides that the closure mechanism comprises at least one resilient flap. The closure mechanism can open and close quickly and with a small pressure gradient. The closure mechanism comprising one or two resilient flaps, has a low weight, which flaps can be operated quickly even in the case of the low forces resulting from the small pressure gradient.

One embodiment provides that the flap is prestressed into a position that closes the check valve. Even though the check valve is already closed by the percussion means during a percussive operation, a closure mechanism that is closed by default has proven to be more suitable for the dynamics.

One embodiment provides that the guide tube comprises a throttle opening. The throttle opening preferably allows for a small, but therefore continuous, airflow between the pneumatic chamber and the surrounding area in order to ensure that the pressure is equalized. One embodiment provides that the throttle opening has a smaller diameter than the outlet opening of the check valve. Provided it has been opened by the percussion means, the check valve dominates the pressure in the pneumatic chamber. One embodiment provides that the cross-sectional area of the throttle opening is less than 6% of the size of the cross-sectional area of the outlet opening. The construction comprising the check valve prevents the percussion mechanism from starting, this being remedied with a time delay by equalizing the pressure with respect to the surrounding area. As stated, the diameter of the throttle opening is preferably adapted to the air moved by the exciter.

BRIEF DESCRIPTION OF THE SEVERAL VIEWS OF THE DRAWINGS

The following description explains the invention on the basis of example embodiments and drawings, in which.

Unless otherwise stated, elements that are the same or have the same function are indicated by the same reference signs in the figures.

DETAILED DESCRIPTION OF THE INVENTION

Figure 1:
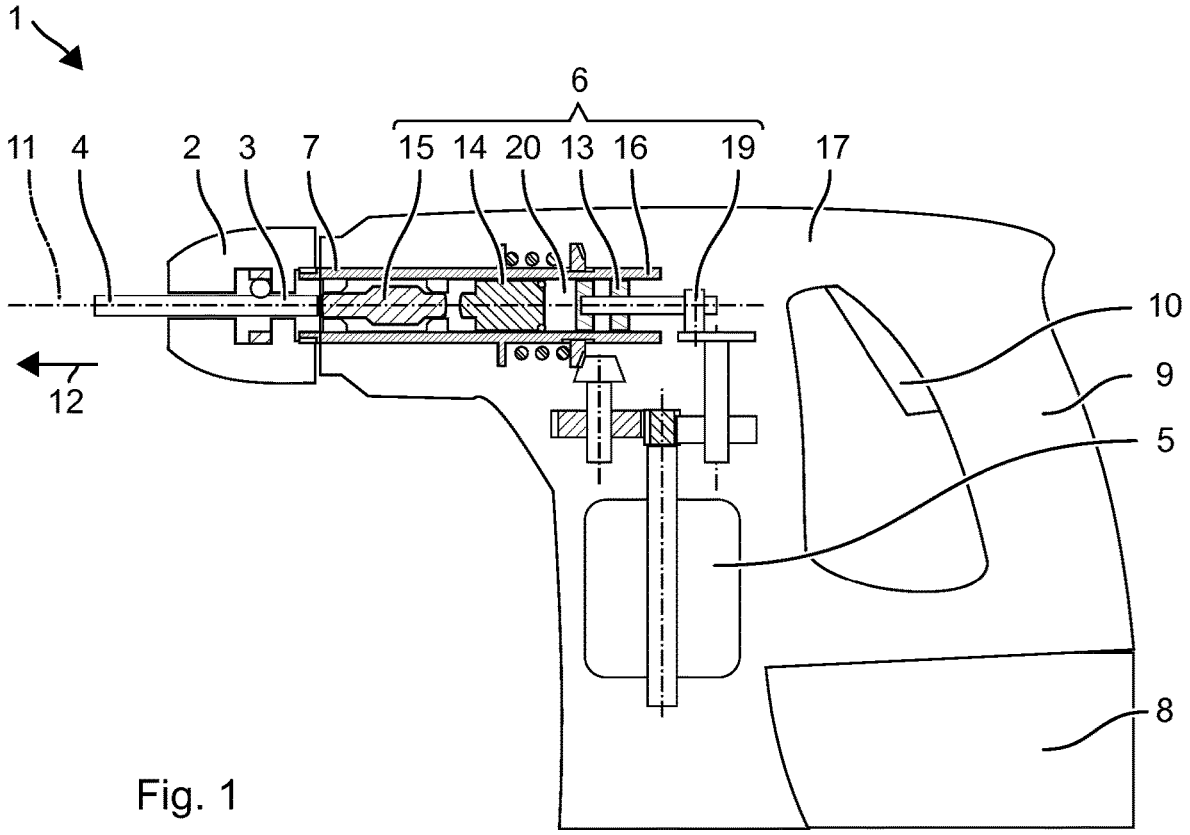
FIG. 1 shows a hammer drill.

FIG. 1 is a schematic view of a hammer drill 1 as an example of a chiseling hand-held machine tool 1. The hammer drill 1 comprises a tool holder 2, in which one end 3 of the shank of a chisel 4 can be inserted and locked. The chisel 4 is an example of percussion tools; the hammer drill 1 can also receive other percussion tools, such as percussive drills 4, core drill bit, etc. A motor 5 forms a primary drive of the hammer drill 1 and drives a percussion mechanism 6 and a driveshaft 7. A battery pack 8 or a mains power cable provides the motor 5 with power. A user can guide the hammer drill 1 by means of a handle 9 and can activate the hammer drill 1 using a system switch 10. During operation, the hammer drill 1 continuously rotates the drill 4 about a working axis 11 and can strike the chisel 4 into a substrate along the working axis 11 in the percussion direction 12 in this case. The hammer drill 1 is an example of chiseling, hand-held machine tools 1, which can also include non-rotary hand-held machine tools, such as an electric chisel.

The chisel 4 is held in the tool holder 2 such that it can move along the working axis 11. During operation, the chisel 4 is held in a working position by a contact pressure acting on the hammer drill 1 in the percussion direction 12. The contact pressure can, inter alia, be applied by the user or by the dead weight of the hammer drill 1. When in the working position, the chisel 4 rests against a stop counter to the percussion direction 12. The percussion mechanism 6 periodically strikes the chisel 4, causing it to be driven out of the working position in the percussion direction 12, in order to machine the substrate. After the blow, the chisel 4 returns to the working position provided that the contact pressure is maintained. The contact pressure may, for example, be lost if the user raises the hammer drill 1 and the chisel 4 from the substrate. In this case, the chisel 4 can remain displaced from the working position in the percussion direction 12.

The percussion mechanism 6 comprises an exciter 13, a percussion means 14 and a rivet header 15 arranged one after the other along the working axis 11 in the percussion direction 12. The exciter 13 is driven by the motor 5. The percussion means 14, which is coupled by means of an air spring, follows the movement of the exciter 13. The percussion means 14 strikes the rivet header 15 in the percussion direction 12. The rivet header 15 passes the blow on to the chisel 4, which is pressed against the tool-side end of the rivet header 15 by the contact pressure.

The percussion mechanism 6 comprises a guide tube 16, which is suspended in the machine housing 17 in parallel with or coaxially with the working axis 11. The percussion means 14 and the exciter 13 are arranged in the guide tube 16. The percussion means 14 and the exciter 13 are piston-shaped, i.e. their circumference rests against the inner surface 18 of the guide tube 16. Sealing rings can improve the air-tight seal between the percussion means 14 or the exciter 13 and the guide tube 16. The guide tube 16 guides the percussion means 14 and the exciter 13 along the working axis 11.

The exciter 13 is forced to periodically move forwards and backwards along the working axis 11 by the motor 5. The exciter 13 is connected to the motor 5 by means of a mechanical deflection device 19. The deflection device 19 contains an eccentric or a wobble finger, for example, and converts the rotary movement of the motor 5 into the periodic, linear forwards and backwards movement. The exciter 13 moves as soon as and for as long as the system switch 10 is actuated, i.e. for as long as the motor 5 is rotating.

A pneumatic chamber 20, which acts as an air spring, is formed between the exciter 13 and the percussion means 14 inside the guide tube 16. The air spring couples the percussion means 14 to the movement of the exciter 13. The exciter 13, which is forced to move, periodically compresses and decompresses the pneumatic chamber 20. On one side, the pressure in the pneumatic chamber 20 acts on the back 21 of the percussion means 14 that faces in the opposite direction to the percussion direction 12. The pressure in the machine housing 17, which is typically equal to the atmospheric pressure of the surrounding area, substantially acts on the front 22 of the percussion means 14. The front 22 is ventilated by means of large openings 23 in the end face of the guide tube 16, for example. The pressure differential between the back 21 and the front 22 accelerates the percussion means 14 in the percussion direction 12 or counter to the percussion direction 12. The percussion means 14 follows the movement of the exciter 13 with a slight time delay. The percussion means 14 oscillates between a point of percussion (cf. FIG. 2), in which the percussion means 14 strikes a percussion surface 24 of the rivet header 15, and a reversal point near the exciter 13. The distance travelled by the percussion means 14, i.e. the position of the point of percussion relative to the exciter 13, is of such a size that the movement of the percussion means 14 is synchronous to the movement of the exciter 13 during a chiseling operation.

The rivet header 15 can move along the working axis 11. The rivet header 15 is held in the working position by means of the contact pressure from the hammer drill 1. The chisel 4 presses on the rivet header 15 counter to the percussion direction 12. The rivet header 15 is pushed into the hammer drill 1 until the rivet header 15 comes to rest against a seat 25 provided therefor. The seat 25 can, for example, be annular and the rivet header 15 rests against the seat 25 by means of an annular shoulder. The percussion surface 24 of the rivet header 15 lies on the point of percussion when the rivet header 15 rests against the seat 25.

Figure 3:
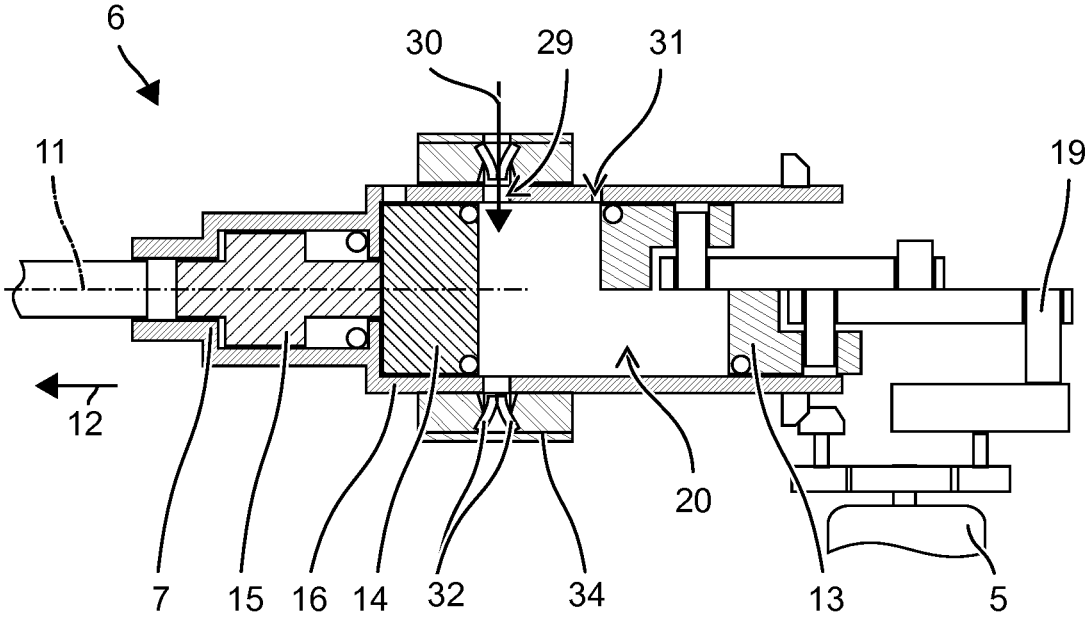
FIG. 3 shows the percussion mechanism in the idling state, comprising two positions of the exciter.

The hammer drill 1 deactivates the chiseling operation by itself when the user raises the hammer drill 1 from the substrate and therefore relieves the contact pressure. The rivet header 15 is no longer forced into the working position, i.e. so as to rest against the seat 25, but can be displaced relative to the working position in the percussion direction 12 (FIG. 3). The percussion means 14 can therefore fly beyond the point of percussion in the percussion direction 12 before the percussion means 14 strikes the rivet header 15.

Figure 2:
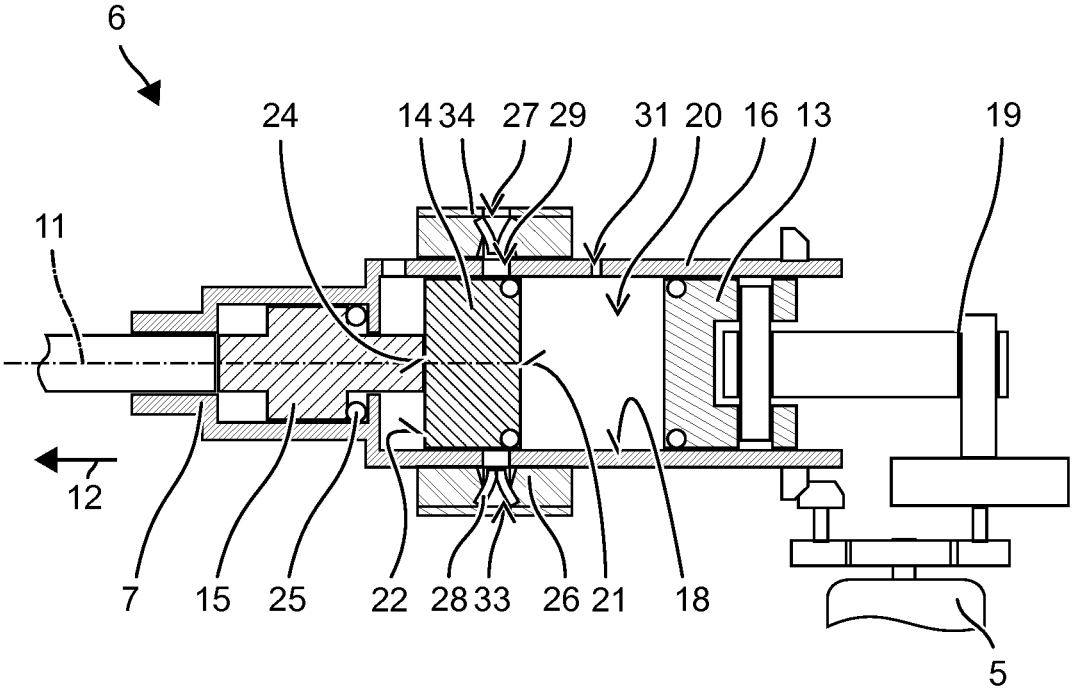
FIG. 2 shows a percussion mechanism when carrying out the percussive operation, i.e. the percussion means in the point of percussion.

The guide tube 16 is provided with a check valve 26. The check valve 26 comprises an inlet opening 27, a closure mechanism 28 and an outlet opening 29. The check valve 26 allows air to be exchanged between the pneumatic chamber 20 and the surrounding area, i.e. the interior of the machine housing. The outlet opening 29 is a radial aperture in the wall of the guide tube 16. When the percussion means 14 is in the point of percussion, the outlet opening 29 either lies in the plane of the back 21 of the percussion means 14 or is offset by 2 mm or less with respect to said plane, for example. The outlet opening 29 is arranged along the working axis 11 such that the percussion means 14 seals the outlet opening 29 with respect to the pneumatic chamber 20 during the chiseling operation. Air cannot be exchanged between the surrounding area and the pneumatic chamber 20 during the chiseling operation. As described above, during a chiseling operation the percussion means 14 only moves in the percussion direction 12 as far as the point of percussion. The percussion means 14 preferably covers part or all of the outlet opening 29 when in the point of percussion (FIG. 2). The outlet opening 29 is open with respect to the pneumatic chamber 20 when the percussion means 14 slides beyond the point of percussion in the percussion direction 12 (FIG. 3). The pneumatic chamber 20 overlaps the outlet opening 29, and air can accordingly be exchanged with the surrounding area. There is still no contact pressure when positioning the hammer drill 1, and the rivet header 15 and the percussion means 14 typically slide in the percussion direction 12, which opens the check valve 26 and allows for air to be exchanged.

The check valve 26 comprises a predetermined flow direction 30 from its inlet opening 27 to its outlet opening 29. A flow of air can pass through the check valve 26 in the flow direction 30; however, the check valve 26 blocks an airflow flowing in the opposite direction to the flow direction 30. The exciter 13 can therefore suck air into the pneumatic chamber 20 through the check valve 26, but cannot blow any air out of the pneumatic chamber 20. The quantity of air in the pneumatic chamber 20 stabilizes after a plurality of cycles and remains constant. The air quantity corresponds to the air quantity of the maximum volume of the pneumatic chamber 20 under atmospheric pressure. The maximum volume of the pneumatic chamber 20 is when the exciter 13 in the position facing away from the percussion means 14 and the percussion means 14 is in its most advanced position in the percussion direction 12. The exciter 13 also moves, causing the air to be periodically compressed. The average pressure in the pneumatic chamber 20 is therefore greater than the atmospheric pressure when the percussion means 14 is positioned beyond the point of percussion. The increased pressure holds the percussion means 14 in the advanced position with respect to the point of percussion in the percussion direction 12. The check valve 26 is held open by the pressure.

When positioning the chisel 4 on the substrate, the rivet header 15 and the percussion means 14 are pushed into the working position or the point of percussion. The percussion means 14 thereby compresses the air, the quantity of which is kept constant, in the pneumatic chamber 20. The user feels a counterpressure as a result, which makes it easier for said user to position the chisel. The counterpressure remains constant for a plurality of revolutions of the exciter 13. The pressure in the pneumatic chamber 20 prevents the percussion mechanism from starting, since the pressure holds the percussion means 14 in the point of percussion. The average pressure continuously decreases over the course of a plurality of revolutions of the exciter 13 until it reaches the atmospheric pressure. The percussion mechanism 6 begins increasingly moving the percussion means 14, as a result of which the percussive power continuously increases as the average pressure in the pneumatic chamber 20 decreases.

The pressure is slowly equalized between the pneumatic chamber 20 and the surrounding area through a throttle opening 31. The throttle opening 31 is a radial opening in the guide tube 16. The throttle opening 31, of which there is typically only one, has a small cross-sectional area. The cross-sectional area is in the range of from 0.05% to 0.20% of the area of the back 21 of the percussion means 14. The small cross-sectional area is sufficient for re-equalizing losses in the quantity of air, in particular during compression, and is small enough not to substantially influence the dynamics of the air spring.

The throttle opening 31 can be arranged in different positions along the working axis 11. The throttle opening 31 is preferably arranged near to the reversal point of the exciter 13, which is near the tool (FIG. 3, upper half of the image). For example, the throttle opening 31 is downstream of the reversal point by between 2 mm and 5 mm in the percussion direction 12. The exciter 13 does not reach the throttle opening 31. The percussion means 14 covers the throttle opening 31 in the compression point, i.e. in its reversal point that is further away from the tool. Alternatively, the throttle opening 31 can be in another position in front of the point of percussion in order to at least temporarily overlap the pneumatic chamber 20 during a percussive operation.

A cross section of the throttle opening 31 is considerably smaller than the cross section of the check valve 26 or the inlet and outlet opening 29 thereof. As long as the percussion means 14 opens the check valve 26 as a result of being in a position in which it has been moved beyond the point of percussion, the airflow through the check valve 26 dominates the pressure in the pneumatic chamber 20. The cross-sectional area of the throttle opening 31 is less than 6%, preferably less than 4%, of the cross-sectional area of the check valve 26. The cross-sectional area of the throttle opening 31 is at least one-hundredth of the cross-sectional area of the outlet opening 29. The check valve 26 preferably comprises a plurality of outlet openings 29, the respective cross sections of which can be added together when comparing with the cross section of the throttle opening 31. The throttle opening 31 comprises a maximum cross-sectional area of no more than 0.20% of the size of the cross-sectional area of the pneumatic chamber 20. The quantity of air in the pneumatic chamber 20 preferably halves within a timeframe of from 500 milliseconds (ms) to 800 ms, which corresponds to approximately ten to fifty revolutions of the exciter 13, depending on the size of the percussion mechanism 6. The percussion mechanism 6 typically starts its percussive action after the air quantity has halved.

The check valve 26 has to open and close sufficiently quickly. The closure mechanism 28 for the check valve 26 is formed by two annular resilient flaps 32, which are arranged in a channel 33 of the check valve 26. The two flaps 32 are secured in a support 34 at their edge that is closer to the inlet opening 27, for example the radially external edge. The inner surfaces of the flaps 32 that face one another are spaced apart in the region of the inlet opening 27. The flaps 32 are inclined with respect to the flow direction 30, and extend towards one another in the flow direction 30. The inner surfaces of the flaps 32 touch in the region of the edges that are closer to the outlet opening 29, for example the radially internal edges. The inner surfaces can rest against one another as a result of prestress that is applied by the flap. The flaps 32 each comprises an outer surface that faces away from the inner surface. The outer surface is exposed in the region of the outlet opening 29 and air can accordingly flow therethrough. The flaps 32 protrude into the channel 33, which is, for example, funnel-shaped and widens towards the outlet opening 29. Alternatively, the closure mechanism 28 can be formed comprising one flap, the edge of which that is closer to the outlet opening 29 coming to rest against an inner surface of the channel 33. The two flaps 32 are made of rubber or a synthetic rubber. The flaps 32 are not acted on by a spring.

Figure 4:
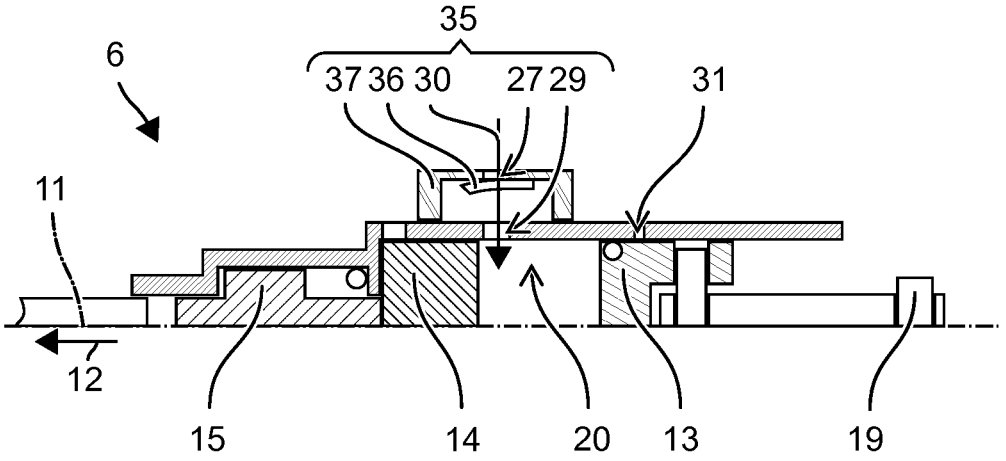
FIG. 4 shows a percussion mechanism comprising a check valve.

FIG. 4 shows another embodiment of a check valve 35, comprising a resilient flap 36. The check valve 35 comprises an inlet opening 27 and an outlet opening 29, the outlet opening in particular is arranged and designed in the same way as in the embodiment described in connection with FIG. 2. The check valve 35 comprises a housing 37, which rests against the guide tube 16 in an air-tight manner. The housing 37 comprises two openings, which form the inlet opening 27 and the outlet opening 29. The flap 36 is arranged inside the cavity in the housing 27 so as to rest against the inlet opening 27. The flap 36 seals and opens the inlet opening 27. The flap 36 can be formed from a resilient tube that covers the inlet opening 27. The flap 36 is made entirely of rubber or a synthetic rubber. The flap 36 is not acted on by a spring. A flow of air in the flow direction 30 presses the flap 36 away from the inlet opening 27 and can flow through the housing 37 and the outlet opening 29, into the pneumatic chamber 20. A flow of air counter to the flow direction 30 presses the flap 36 against the inlet opening 27 and blocks the check valve 35. The flap 36 can be resiliently prestressed so as to rest against the inlet opening 27.

Figure 5:
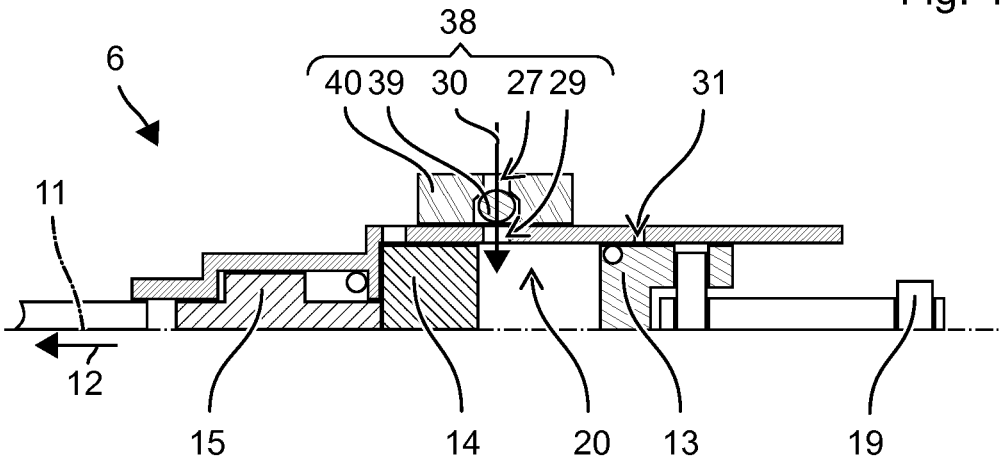
FIG. 5 shows a percussion mechanism comprising a check valve.

FIG. 5 shows another embodiment of a check valve 38, comprising a resilient sealing element 39. The sealing element 39 is a resilient ring, for example, which is made entirely of rubber or a synthetic rubber. The check valve 38 comprises a housing 40, which sealingly rests against the guide tube 16. The housing 40 forms the inlet opening 27 and the outlet opening 29. The outlet opening 29 is arranged and designed in the same way as in the preceding embodiments. The housing 40 comprises a channel, which tapers counter to the flow direction 30 and in which the sealing element 39 is arranged. The sealing element 39 preferably rests against the inlet opening 27 as a result of its resilient internal stress. The sealing element 39 can be radially elastically deformed, i.e. perpendicularly to the working axis 11, thereby unblocking the inlet opening 27.

Figure 6:
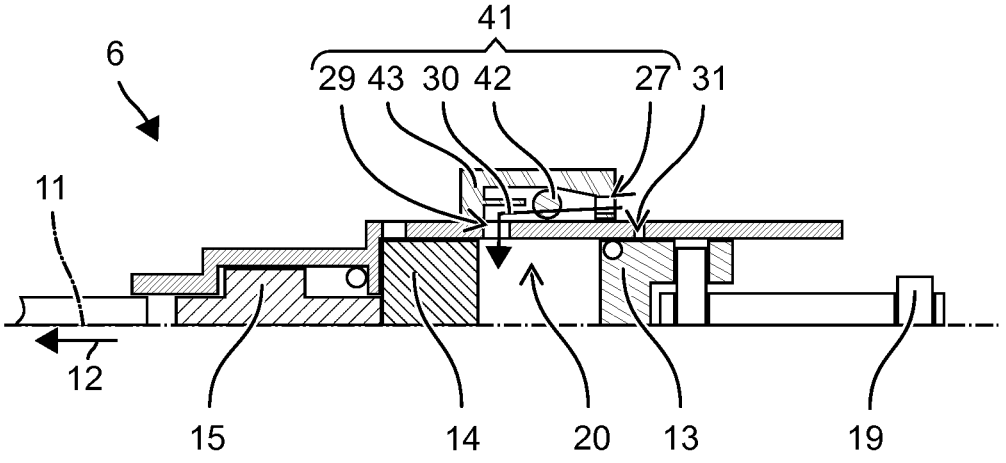
FIG. 6 shows a percussion mechanism comprising a check valve.

FIG. 6 shows another embodiment of a check valve 41. The check valve 41 comprises a movable sealing element 42. A housing 43 forms the inlet opening 27 and the outlet opening 29. The outlet opening 29 is arranged and designed in the same way as in the preceding embodiments. The housing 43 comprises a channel, which tapers counter to the flow direction 30 and in which the sealing element 42 is arranged. The sealing element 42 can move in the flow direction 30. The sealing element 42 is a rubber or synthetic-rubber ring, for example. The sealing element 42 is not acted on by a spring.

The invention claimed is:

1. A percussion machine tool, comprising a tool holder for holding a percussion tool on a working axis; a motor; a percussion mechanism, which comprises a guide tube having an interior; an exciter piston that is forced to move periodically in a percussion direction along the working axis inside the guide tube by the motor; a percussion piston that slides along the working axis inside the guide tube; a pneumatic chamber, which is enclosed by the exciter piston and the percussion piston inside the guide tube, for coupling the percussion piston to the movement of the exciter piston; a rivet header and a seat for the rivet header, the rivet header having a percussion surface; wherein the percussion mechanism comprises a point of percussion for the percussion piston, the point of percussion being defined by the percussion surface of the rivet header that faces the percussion piston when the rivet header rests against the seat counter to the percussion direction; a throttle opening comprising a radial opening in the guide tube; and, a check valve, having an outlet opening that is arranged in the guide tube and a closure mechanism for closing the check valve with respect to a flow of air passing out of the interior of the guide tube, wherein the outlet opening is arranged along the working axis such that the percussion piston seals the outlet opening with respect to the pneumatic chamber when the percussion piston is in front of the point of percussion in the percussion direction, and such that the pneumatic chamber overlaps the outlet opening when the percussion piston moves beyond the point of percussion in the percussion direction, and wherein a cross-sectional area of the throttle opening is less than 6% of a size of a cross-sectional area of the outlet opening.

2. The percussion machine tool according to claim 1, wherein the closure mechanism comprises at least one resilient flap.

3. The percussion machine according to claim 2, wherein the flap is prestressed into a position that closes the check valve.

4. The percussion machine tool according to claim 1, wherein the closure mechanism comprises a resilient sealing element, which rests against an inlet opening of the check valve as a result of internal stress of the resilient sealing element.

5. The percussion machine tool according to claim 1, wherein a cross-sectional area of the throttle opening is smaller than a cross-section area of the outlet opening of the check valve.

6. The percussion machine tool of claim 5, wherein the throttle opening is arranged on the guide tube downstream of a reversal point of the percussion piston by between 2 mm and 5 mm in the percussion direction.

7. The percussion machine tool according to claim 1, wherein the guide tube guides the piston.

8. The percussion machine tool of claim 1, wherein the throttle opening is arranged on the guide tube downstream of a reversal point of the percussion piston by between 2 mm and 5 mm in the percussion direction.

9. A percussion machine tool, comprising a tool holder for holding a percussion tool on a working axis; a motor;

a percussion mechanism, which comprises a guide tube having an interior; an exciter piston that is forced to move periodically in a percussion direction along the working axis inside the guide tube by the motor; a percussion piston that slides along the working axis inside the guide tube; a pneumatic chamber, which is enclosed by the exciter piston and the percussion piston inside the guide tube, for coupling the percussion piston to the movement of the exciter piston; a rivet header and a seat for the rivet header, the rivet header having a percussion surface; wherein the percussion mechanism comprises a point of percussion for the percussion piston, the point of percussion being defined by the percussion surface of the rivet header that faces the percussion piston when the rivet header rests against the seat counter to the percussion direction; a throttle opening comprising a radial opening in the guide tube, wherein the throttle opening is arranged on the guide tube downstream of a reversal point of the percussion piston by between 2 mm and 5 mm in the percussion direction; and, a check valve, having an outlet opening that is arranged in the guide tube and a closure mechanism for closing the check valve with respect to a flow of air passing out of the interior of the guide tube, wherein the outlet opening is arranged along the working axis such that the percussion piston seals the outlet opening with respect to the pneumatic chamber when the percussion piston is in front of the point of percussion in the percussion direction, and such that the pneumatic chamber overlaps the outlet opening when the percussion piston moves beyond the point of percussion in the percussion direction.

* * * * *